United States Patent [19]

Voss et al.

[11] Patent Number: 4,986,071

[45] Date of Patent: Jan. 22, 1991

[54] FAST RESPONSE LOAD SENSE CONTROL SYSTEM

[75] Inventors: Dennis A. Voss, Mt. Prospect; Gary A. Gruber, Elmhurst, both of Ill.

[73] Assignee: Komatsu Dresser Company, Libertyville, Ill.

[21] Appl. No.: 361,217

[22] Filed: Jun. 5, 1989

[51] Int. Cl.[5] ..... F15B 13/12

[52] U.S. Cl. ..... 60/420; 60/427; 60/450

[58] Field of Search ..... 60/420, 427, 450, 452

[56] References Cited

U.S. PATENT DOCUMENTS

| | | | |
|---|---|---|---|
| 2,892,312 | 6/1959 | Allen et al. | 60/427 |
| 3,987,623 | 10/1976 | Bianchetta | 60/427 X |
| 4,043,419 | 8/1977 | Larson et al. | 60/420 X |
| 4,343,152 | 8/1982 | Habiger | 60/452 |
| 4,349,319 | 9/1982 | Byers, Jr. et al. | 417/222 |
| 4,425,759 | 1/1984 | Krusche | 60/420 |
| 4,479,349 | 10/1984 | Westveer | 60/420 X |
| 4,481,770 | 11/1984 | Lohbauer et al. | 60/452 |
| 4,498,847 | 2/1985 | Akiyama | 417/216 |
| 4,617,798 | 10/1986 | Krusche et al. | 60/450 |
| 4,665,699 | 5/1987 | Krusche | 60/452 |
| 4,738,279 | 4/1988 | Kropp | 137/596 |
| 4,879,945 | 11/1989 | Brunner et al. | 91/518 |

FOREIGN PATENT DOCUMENTS

| | | | |
|---|---|---|---|
| 16701 | 2/1979 | Japan | 60/420 |
| 37305 | 2/1984 | Japan | 60/427 |

*Primary Examiner*—Edward K. Look
*Assistant Examiner*—George Kapsalas

[57] ABSTRACT

A source of pressurized hydraulic fluid has a variable fluid output rate and a control system which varies the fluid output rate responsive to a load sense control signal, e.g., a variable displacement pump. The pressurized fluid is made available to a plurality of hydraulic actuators through a corresponding plurality of work control valves. A load sense line is utilized to sense the pressure of the fluid in each hydraulic actuator and to apply a total load sense signal to the control system. A conduit containing a pressure reducing valve provides fluid communication between the output of the source of fluid and the load sense line to pass fluid therethrough to the load sense line only when the pressure in the load sense line is less than a predetermined value. Maintaining at least this minimum pressure in the load sense line minimizes lag in the load sense signal which would otherwise occur as a result of the loss of fluid in the load sense line due to the bleeding of the load sense line.

15 Claims, 1 Drawing Sheet

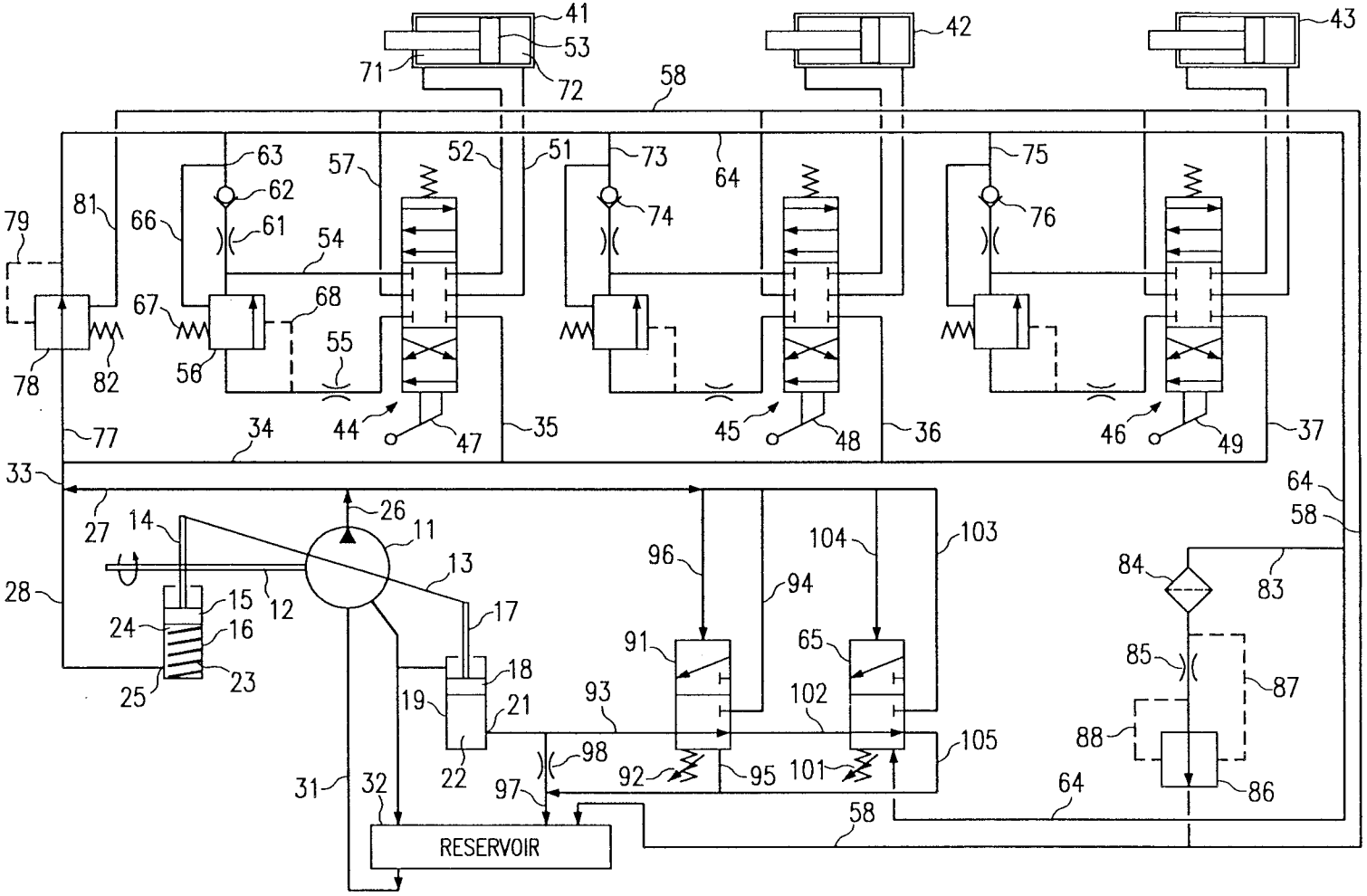
RESERVOIR

FAST RESPONSE LOAD SENSE CONTROL SYSTEM

FIELD OF THE INVENTION

This invention relates to a fluid pressure control system for a fluid source having an adjustable delivery rate. In one aspect, the invention relates to a fast response fluid pressure control system which varies the fluid output of a hydraulic pump responsive to the instantaneous load demand of one or more fluid motors powered by the pump.

BACKGROUND OF THE INVENTION

In hydraulic systems wherein hydraulic fluid from a variable displacement pump or other source of pressurized hydraulic fluid is supplied to one or more hydraulic actuators, such as a double acting hydraulic piston actuator, and wherein the desired flow rate of pressurized hydraulic fluid is determined by the total flow required instantaneously to all activated actuators, various systems have been utilized to sense the fluid pressure in the hydraulic actuator as an indication of the load demand of the actuator and to transmit such fluid pressure as a control signal to a device for controlling the discharge rate from the source of pressurized fluid.

In order for the load demand control signal to follow decreases in fluid pressure in the actuator, representing drops in load demand, it is necessary to bleed the fluid pressure of the control signal to a reservoir. The bleed rate must be sufficiently rapid to permit the desired responsiveness of the control ,signal. However, when the hydraulic actuators have been inactive for even a short period of time, the control signal can drop all the way to the reservoir pressure, with some or all of the hydraulic fluid in the load demand control signal line having drained through the bleed restriction into the reservoir. Thereafter, when one of the hydraulic actuators is activated, the load demand pressure signal lags behind the pressure of the hydraulic fluid going to the actuator. This lag is the result of the time required to refill the load demand signal line and bring the pressure therein up to the value corresponding to the load demand.

Such systems are utilized in various types of mobile equipment such as backhoes, loaders, agricultural tractors, road graders, etc., wherein the operator manually moves actuating levers to control hydraulic functions, such as power steering, raising or lowering of attachments, and the like. When the operator moves one of the actuating levers, he expects an immediate response with the desired movement of the function he was trying to adjust. However, the output of the pressurized fluid source is not sufficient to provide the increased hydraulic fluid demand, because the load sense pressure signal has not yet activated the device that controls the discharge rate of the pressurized fluid source to increase the discharge rate as needed to meet the new demand. The delay in actuation of the discharge rate control device is due to the lag in the load sense pressure signal, caused by prior partial draining of the load sense line. This delay in the response of the function which the operator is trying to adjust makes it difficult for the operator to control the function accurately. This is particularly acute when the operator is attempting multiple operations simultaneously, such as varying the angle and elevation of a blade on a road grader or lowering the boom and actuating the scoop on a backhoe.

The system response of the hydraulic system is affected by the type of conduit used for the load sense line, e.g., hose or tubing, the inside diameter of the line, and oil compressibility. However, changes in these parameters did not overcome the lag problem and achieve satisfactory results. One way to hold a residual pressure in the load sense line would be to employ a plurality of orifices located in series; however, such residual pressure would be unstable and temperature sensitive.

SUMMARY OF THE INVENTION

The purpose of the invention is to improve the response and controllability of the hydraulic system during changes in the load demands presented by one or more hydraulic actuators. This is accomplished by maintaining the load sense line liquid full with a stable, elevated minimum pressure even at zero load demand. A pressure control valve is connected in fluid communication between the discharge outlet of the pressurized fluid source and the load sense line, with the valve passing fluid to the load sense line whenever the fluid pressure in the load sense line is less than a predetermined minimum value, and the valve blocking such passage whenever the fluid pressure in the load sense line is higher than said predetermined minimum value. A hydraulic reducing valve, which responds to the fluid pressure at the valve outlet, can be employed for this purpose. A bias spring and a pressure signal representing reservoir pressure can be utilized in opposition to such downstream pressure, to compensate the valve output for variations in temperature and compressibility of the hydraulic fluid.

The bleed line between the load sense line and the reservoir can be provided with a flow controller which varies the flow rate through a bleed orifice responsive to the pressure drop across the bleed orifice, thereby compensating the bleed rate against variations in load sense line pressure.

Accordingly, it is an object of the invention to provide a new and improved hydraulic system which incorporates load demand compensation. Another object of the invention is to improve the response and controllability characteristics of a hydraulic system which utilizes load demand compensation. A further object of the invention is to provide a stable threshold pressure in the load sense line of a hydraulic system. It is an object of the invention to provide a new and improved control system for a variable output source of hydraulic fluid.

Other objects, aspects and advantages of the invention will be apparent from the accompanying drawing and the following description.

BRIEF DESCRIPTION OF THE DRAWING

The single FIGURE is a schematic representation of a hydraulic system utilizing load demand compensation in accordance with the present invention.

DETAILED DESCRIPTION

Referring now to the single FIGURE, a variable displacement pump 11 of the swash plate type is driven by rotating shaft 12, with the fluid output of pump 11 being varied according to the angle of the swash plate. The swash plate angle is varied according to the position of stroking lever 13. One end of stroking lever 13 is connected by arm 14 to a piston 15 reciprocally positioned in cylinder 16, while the other end of stroking lever 13 is connected by arm 17 to a piston 18 reciprocally positioned in cylinder 19. A control signal port 21 is provided in cylinder 19 in fluid communication with chamber 22 located therein. Chamber 22 is on the side of piston 18 opposite to that to which arm 17 is connected. A spring 23 is positioned in chamber 24 of cylinder 16, with spring 23 being under compression between piston 15 and one end of cylinder 16. A pump pressure feedback port 25 is provided in cylinder 16 in fluid communication with chamber 24. Thus, spring 23 and the fluid pressure in chamber 24 tend to move stroking lever 13 in one direction while the fluid pressure in chamber 22 tends to move stroking lever 13 in the opposite direction. An increase in pressure in chamber 22 will act to reduce the fluid output of pump 11, while a decrease in pressure in chamber 22 will act to increase the fluid output of pump 11. The output of pump 11 is connected through conduits 26, 27 and 28 to the pressure feedback port 25 so that the pressure in chamber 24 serves to adjust the control of the swash plate to compensate for variations in pump output pressure.

Conduit 31 provides fluid communications between the fluid inlet of pump 11 and an outlet of hydraulic fluid reservoir 32. Conduits 26, 27, 33 and 34 serve as the primary delivery line for supplying hydraulic fluid under pressure from the discharge output of pump 11 through branch delivery lines 35, 36 and 37 leading to hydraulic actuator devices 41, 42 and 43 which are consumers of hydrostatic energy. Devices 41, 42 and 43 can be any suitable type of actuator, e.g., linear or rotary, with linear including both one-way and two-way hydraulic pistons, and rotary including both reversible and non-reversible motors. However, for simplicity in illustration, device 41, 42 and 43 have been shown as two-way hydraulic piston actuators.

Work control valves 44, 45 and 46 are operatively connected to the branch lines 35, 36 and 37, respectively, to selectively permit or block work fluid flow through the branch line to the respective consumer device. When the consumer device is bi-directional, the work control valve can also provide for the proper direction of flow of work fluid through each port of the consumer device. While valves 44, 45 and 46 can be any suitable type of valves, they are illustrated as closed center valves, manually actuated by levers 47, 48 and 49, respectively, with springs biasing the spools of the valves to the center position. The spools of valves 44, 45 and 46 have three positions: the illustrated center or neutral position, the fully "up" position, and the fully "down" position.

As the illustrated work control valves and consumer devices are identical, only one set will be described in detail. Valve 44 has six ports, with branch conduit 35 being connected to the first port. Conduit 51 connects the second port of valve 44 to the first port of hydraulic piston actuator 41, while conduit 52 connects the third port of valve 44 to the second port of actuator 41. The first and second ports of actuator 41 are located on opposite sides of piston 53, which is reciprocally positioned in actuator 41. Conduit 54, containing a restriction 55 and a pressure compensator 56, connects the fourth port of valve 44 to the sixth port of valve 44. Branch conduit 57 and collector conduit 58 connect the fifth port of valve 44 to an inlet of reservoir 32. A restriction 61 is connected between the inlet of check valve 62 and a point in conduit 54 between pressure compensator 56 and the sixth port of valve 44. A branch conduit 63 and load sense pilot conduit 64 connect the outlet of check valve 62 to a control port of load sense control valve 65. A conduit 66 connects the outlet of check valve 62 to one control port of pressure compensator 56 to assist the bias provided by a light compression spring 67, while a conduit 68 connects the opposing control port of pressure compensator 56 to conduit 54 at a point between restriction 55 and the process fluid inlet of pressure compensator 56.

In the illustrated center position for the spool of valve 44, all of the six ports are isolated from each other, there is no flow of work fluid to or from either port of piston actuator 41. Thus piston 53 is maintained in its current static position. Upon the actuation of lever 47 to move the spool of valve 44 to the fully "down" position, valve 44 provides fluid communication between the first and fourth ports, between the second and fifth ports, and between the third and sixth ports. In this position, hydraulic work fluid from branch conduit 35 passes through conduit 54, restriction 55, pressure compensator 56 and conduit 52 to the "left" chamber 71 of piston actuator 41. Hydraulic fluid from the "right" chamber 72 of piston actuator 41 passes through conduits 51, 57 and 58 to reservoir 32. A relatively small flow of hydraulic fluid passes through resistor 61, check valve 62 and conduits 63 and 64 to a control port of valve 65. The pressure of the fluid in conduit 54 varies according to the rate of flow through conduit 52 and thus the pressure at the inlet of check valve 62 is representative of the instantaneous load demanded by actuator 41.

In the fully "up" position of the spool of valve 44, the first and fourth ports are again interconnected; however, the second port is now connected to the sixth port, and the third port is now connected to the fifth port of valve 44. In this valve position, hydraulic fluid from branch conduit 35 passes through conduit 54, restriction 55, pressure compensator 56, and conduit 51 to the "right" chamber 72 of actuator 41, while fluid from the "left" chamber 71 passes through conduits 52, 57 and 58 to reservoir 32. Again the fluid pressure at the inlet of check valve 62 is representative of the instantaneous load demanded by actuator 41.

Conduit 73 connects the outlet of check valve 74 to load sense conduit 64, while conduit 75 connects the outlet of check valve 76 to load sense conduit 64. Thus, the pressure in conduit 64 is representative of the instantaneous load total demand for hydraulic actuators 41, 42 and 43, regardless of whether one or more work control valves 44, 45 and 46 is in the neutral or central position.

In order to provide a non-zero reference value for the load sense pressure signal corresponding to a zero demand where all of valves 44, 45 and 46 are in the closed center position, and to provide for a faster response of the swash plate control mechanism when the system moves from a zero load demand to a small load demand, a conduit 77, containing a pressure reduction valve 78, is connected between distribution conduit 33 and load sense line 64. Conduit 79 connects one control port of valve 78 to conduit 77 downstream of valve 78, while conduit 81 connects the opposite control port of valve 78 to reservoir return line 58. A spring 82 provides a bias force on valve 78, so that valve 78 is opened whenever the pressure in the load sense conduit 64 is less than the sum of the reservoir pressure and the force of spring 82. Similarly, valve 78 is closed whenever the pressure in load sense conduit 64 exceeds the sum of the reservoir pressure and the force of spring 82. Spring 82 can be selected to provide any desired base line pressure in conduit 64, e.g., 140 psi.

Conduit 83, containing a filter 84, an orifice 85 and a flow controller 86, provides fluid communication between load sense conduit 64 and reservoir return conduit 58. A pilot line 87 is connected between one control port of controller 86 and a point in conduit 83 just upstream of orifice 85, while pilot line 88 is connected between the other control port of controller 86 and a point in conduit 83 just downstream of orifice 85. Orifice 85 is sized to provide the desired bleed rate of hydraulic fluid from load sense conduit 64 to reservoir 32, and controller 86 maintains that desired bleed rate so long as the pressure in conduit 64 is above the threshold value necessary to achieve that bleed rate. The bleed rate through conduit 83 is chosen to be sufficiently large to provide the desired rate of response when the total load demand drops and yet small enough to minimize the energy consumption by pump 11 required to maintain a total load demand signal during the period that a high load demand exists.

Pressure relief valve 91 is a two position hydraulically actuated valve having first and second control ports and first, second and third process flow ports. The spool of valve 91 is biased toward its "up" or normal position by a spring 92. Conduit 93 connects control signal port 21 to the first process flow port of valve 91. Conduits 94, 27 and 26 connect the discharge outlet of pump 11 to the second process flow port of valve 91. Conduit 95 connects the first or "lower" control port of valve 91 to reservoir 32, while conduit 96, 27 and 26 connect the second or "upper" control port of valve 91 to the discharge outlet of pump 11.

Thus, valve 91 is in the normal position so long as the difference between the pump outlet pressure and reservoir pressure is less than a predetermined relief pressure represented by spring 92, e.g., 2800 psi. When the pump outlet pressure exceeds the reservoir pressure by at least 2800 psi, valve 91 is actuated to the "down" or relief position. In the "down" position, the first and second process flow ports of valve 91 are interconnected and the hydraulic fluid pressure of the pump discharge outlet is transmitted through conduits 26, 27, 94 and 93 to chamber 22, promptly moving piston 18 to reduce the output of pump 11. When the pump output has decreased sufficiently for the pump discharge pressure to drop below 2800 psi above the reservoir pressure, spring 92 returns valve 91 to its normal "up" position. A conduit 97, containing a restriction 98, is connected between conduit 93 and reservoir 32 to permit the pressure in conduit 93 and chamber 22 to return to its normal operating range by bleeding the hydraulic fluid from conduit 93 into reservoir 32.

Load sense control valve 65 is a two position hydraulically actuated valve having first and second control ports and first, second and third process flow ports. Valve 65 is biased toward its "up" position by spring 101. Conduit 102 connects the third process flow port of pressure relief valve 91 to the first process flow port of load sense control valve 65. Conduits 103, 27 and 26 connect the discharge outlet of pump 11 to the second process flow port of valve 65. Conduit 64 is connected to the first or "lower" control port of valve 65, while conduits 104, 27 and 26 connect the second or "upper" control port of valve 65 to the discharge outlet of pump 11. Conduit 105 connects the third process flow port of valve 65 to reservoir 32. Valve 65 is in its "up" position so long as the sum of the load sense signal pressure in conduit 64 and the value represented by spring 101 exceeds the pump discharge pressure in conduit 104.

In their "up" positions, valves 91 and 65 provide direct fluid communication between reservoir 32 and chamber 22 in swash plate angle control cylinder 19 via conduits 93, 102 and 105, thereby causing the pressure in chamber 22 to approach or even reach the pressure in reservoir 32. This results in a corresponding increase in the hydraulic fluid passing through the discharge outlet of pump 11. When the load sense pressure signal in conduit 64 decreases to the point that the sum of the pressure in conduit 64 and the pressure force represented by spring 101 is less than the discharge pressure of pump 11 in conduit 104, valve 65 is actuated to its "down" position, interconnecting the first and second ports of valve 65 and transmitting hydraulic fluid through conduits 103, 102 and 93 into chamber 22. The pressure in chamber 22 increases, moving piston 18 upwardly to reduce the discharge rate of pump 11. Under normal operating conditions, valve 65 will oscillate between its two positions to maintain the pump discharge rate at a value required by the instantaneous load demand for consumer device 41, 42 and 43. Thus, for the embodiment of the invention illustrated int he drawing, the lower control port of valve 65 can be considered to be the control signal port of the control system which varies the fluid output rate of the pump 11 responsive to the magnitude of the fluid pressure in conduit 64.

While the invention has been illustrated in terms of a variable displacement pump of the swash plate type, other adjustable pumps can be employed as the pressurized fluid source, as can a pressure compensated control valve. The pressurized fluid source can be any source of hydraulic fluid at elevated pressures wherein the discharge rate of the source can be controlled responsive to a load demand hydraulic signal. Similarly, while the system has been described in terms of valves and separate conduits, it is frequently desirable for many of he conduits to be internal passageways provided int he valve structure, thereby reducing the length of the fluid paths as well as reducing the cost of the system. The hydraulic system can employ more or fewer hydraulic actuators than the three illustrated, and the actuators can be of the same type or of multiple types. The work control valves can be any suitable type to control the direction of flow and/or rate of flow of hydraulic fluid to the actuators. When each individual conduit to a bi-direction actuator is connected through a branch load sense line, the branch load sense lines can be provided with check valves to prevent backflow of load sense pressure signal fluid into the conduit being exhausted to the reservoir. Other reasonable variations and modifications are possible within the scope of the foregoing description and the appended claims to the invention.

We claim:

1. Apparatus comprising a source of pressurized hydraulic fluid having an outlet with a variable fluid output rate and having a control system which varies the fluid output rate of said outlet responsive to the magnitude of fluid pressure applied to a control signal port of said control system, at least one consumer device which consumes hydrostatic energy and has a fluid inlet, a consumer delivery line providing fluid communication between said outlet of said source of fluid and said fluid inlet of said consumer device, a process control valve operatively positioned in said consumer delivery line for selectively permitting or blocking fluid flow from said source of fluid through said consumer delivery line to said consumer device, a load sense line providing fluid communication between said control signal port of said control system and said delivery line at a location between said process control valve and said consumer device to pass a pressure signal to said control signal port responsive to the load demand of said consumer device as represented by the pressure of the fluid at said location in said consumer delivery line, a fluid receiver, a first restricted bleed line providing fluid communication between said control signal port of said control system and said fluid receiver to bleed fluid from said control signal port and said load sense line into said fluid receive, a first fluid line providing fluid communication between said outlet of said source of fluid and said load sense line, and a pressure reducing valve operatively positioned in said first fluid line to pass fluid from said source of fluid into said load sense line whenever the pressure of the fluid in said load sense line is less than a predetermined value and to block the passage of fluid through said first fluid line to said load sense line whenever the pressure of the fluid in said load sense line is greater than said predetermined value.

2. Apparatus in accordance with claim 1 wherein said consumer device is one of a plurality of consumer devices, each having at least one fluid inlet; wherein said consumer delivery line is one of a plurality of consumer delivery lines, each being connected between said outlet of said source of fluid and a respective consumer device fluid inlet, each consumer delivery line having a process control valve operatively positioned therein for selectively permitting or blocking fluid flow therethrough from said outlet of said source of fluid to the respective consumer device fluid inlet; and wherein said load sense line provides fluid communication between said control signal port and each of said plurality of consumer delivery lines at a location between the respective process control valve and the respective consumer device.

3. Apparatus in accordance with claim 2 wherein said load sense line has a plurality of branches, with each branch being connected to a respective consumer delivery line, each of said branches containing a restriction and a check valve, and wherein said first fluid line is connected to said load sense line downstream of said branches.

4. Apparatus in accordance with claim 1 wherein said pressure reducing valve has first and second control ports, a conduit providing fluid communication between said first control port of said pressure reducing valve and a location in said first fluid line on the side of said pressure reducing valve away from said source of fluid, a conduit providing fluid communication between said second control port of said pressure reducing valve and said fluid reservoir, and a spring biasing said pressure reducing valve in opposition to the fluid pressure in said first control port of said pressure reducing valve, the pressure in said first control port of said pressuring reducing valve acting to close said pressure reducing valve when the pressure in said first control port of said pressure reducing valve exceeds the combination of the pressure in said second control port of said pressure reducing valve and the force of said spring biasing said pressure reducing valve.

5. Apparatus in accordance with claim 4 wherein said source of fluid is a variable displacement pump.

6. Apparatus in accordance with claim 1 wherein said source of fluid is a variable displacement pump.

7. Apparatus in accordance with claim 6 wherein said consumer device is one of a plurality of consumer devices, each having at least one fluid inlet; wherein said consumer delivery line is one of a plurality of consumer delivery lines, each being connected between said outlet of said source of fluid and a respective consumer device fluid inlet, each consumer delivery line having a process control valve operatively positioned therein for selectively permitting or blocking fluid flow therethrough from said outlet of said source of fluid to the respective consumer device fluid inlet; and wherein said load sense line provides fluid communication between said control signal port and each of said plurality of consumer delivery lines at a location between the respective process control valve and the respective consumer device.

8. Apparatus in accordance with claim 1 wherein said first restricted bleed line comprises a bleed conduit containing an orifice and a flow controller with the flow controller being operable to vary the flow of fluid through said bleed conduit to maintain the pressure drop across said orifice at a predetermined value.

9. Apparatus in accordance with claim 1 wherein said process control valve is a closed center type.

10. Apparatus in accordance with claim 1 wherein said load sense line contains a restriction and a check valve between said consumer device and the junction of said load sense line and said first fluid line.

11. Apparatus comprising a source of pressurized hydraulic fluid having an outlet with a variable fluid output rate of said outlet responsive to the magnitude of fluid pressure applied to a control signal port of said control system, at least one consumer device which consumes hydrostatic energy and has a fluid inlet, a consumer delivery line providing fluid communication between said outlet of said source of fluid and said fluid inlet of said consumer device, a process control valve operatively positioned in said consumer delivery line for selectively permitting or blocking fluid flow from said source of fluid through said consumer delivery line to said consumer device, a load sense line providing fluid communication between said control signal port of said control system and said delivery line at a location between said process control valve and said consumer device to pass a pressure signal to said control signal port responsive to the load demand of said consumer device as represented by the pressure of the fluid at said location in said consumer delivery line, a fluid receiver, a first restricted bleed line providing fluid communication between said control signal port of said control system and said fluid receiver to bleed fluid from said control signal port and said load sense line into said fluid receiver, a first fluid line providing fluid communication between said outlet of said source of fluid and said load sense line, and a pressure reducing valve operatively positioned in said first fluid line to pass fluid from said source of fluid into said load sense line whenever the pressure of the fluid in said load sense line is less than a predetermined value and to block the passage of fluid through said first fluid line to said load sense line whenever the pressure of the fluid in said load sense line is greater than said predetermined value, wherein said consumer device is one of a plurality of consumer devices, each having at least one fluid inlet; wherein said consumer delivery line is one of a plurality of consumer delivery lines, each being connected between said outlet of said source of fluid and a respective consumer device fluid inlet, each consumer delivery line having a process control valve operatively positioned therein for selectively permitting or blocking fluid flow therethrough from said outlet of said source of fluid to the respective consumer device fluid inlet; and wherein said load sense lien provides fluid communication between said control signal port and each of said plurality of consumer delivery lines at a location between the respective process control valve and the respective consumer device, wherein said load sense line as a plurality of branches, with each branch being connected to a respective consumer delivery line, each of said branches containing a restriction and a check valve, and wherein said first fluid lien is connected to said load sense line downstream of said branches; and wherein said control system comprises a control element for varying the fluid output rate from said outlet of said source of fluid, said control element having a control signal port, a pilot valve having first and second control ports and first, second and third fluid ports, said pilot valve having a first position wherein said first fluid port is connected to said second fluid port and a second position wherein said first fluid port is connected to said third fluid port, said pilot valve being actuable between said first and second positions responsive to the difference in the pressures at said first and second control ports of said pilot valve, said second control port of said pilot valve being said control signal port of said control system, a second fluid line connecting said control signal port of said control element to said first fluid port of said pilot valve to transmit fluid pressure between said first fluid port and said control signal port of said control element, a third fluid lien connecting said outlet of said source of fluid to said second port of said pilot valve, a fourth fluid line connecting said third fluid port of said pilot valve to said fluid receiver to pass fluid from said third fluid port into said fluid receiver, a fifth fluid line connecting said outlet of said source of fluid to said first control port of said pilot valve, and a second restricted bleed line connecting said control signal port of said control element and said fluid receiver to bleed fluid from said control signal port of said control element and said second fluid line into said fluid receiver.

12. Apparatus in accordance with claim 11 wherein said first restricted bleed line comprises a bleed conduit containing an orifice and a flow controller with the flow controller being operable to vary the flow of fluid through said bleed conduit to maintain the pressure drop across said orifice at a predetermined value.

13. Apparatus in accordance with claim 12 wherein said source of fluid is a variable displacement pump and wherein said control element comprises a body having a piston chamber therein, a piston reciprocatably mounted in said piston chamber and dividing said piston chamber into first and second end chambers, said control signal port of said control element providing fluid communication between said first end chamber and said second fluid line so that fluid pressure in said second fluid line will urge said piston toward said second end chamber, and a biasing element associated with said piston to urge said piston toward said first end chamber.

14. Apparatus in accordance with claim 13 wherein each of said process control valves is a closed center type.

15. Apparatus in accordance with claim 14 wherein said pressure reducing valve has first and second control ports, a conduit providing fluid communication between said first control port of said pressure reducing valve and a location in said first fluid line on the side of said pressure reducing valve away from said source of fluid, a conduit providing fluid communication between said second control port of said pressure reducing valve and said fluid reservoir, and a spring biasing said pressure reducing valve in opposition to the fluid pressure in said first control port of said pressure reducing valve, the pressure in said first control port of said pressuring reducing valve acting to close said pressure reducing valve when the pressure in said first control port of said pressure reducing valve exceeds the combination of the pressure in said second control port of said pressure reducing valve and the force of said spring biasing said pressure reducing valve.

* * * * *

UNITED STATES PATENT AND TRADEMARK OFFICE

CERTIFICATE OF CORRECTION

PATENT NO. : 4,986,071

DATED : January 22, 1991

INVENTOR(S) : Dennis A. Voss and Gary A. Gruber

It is certified that error appears in the above-identified patent and that said Letters Patent is hereby corrected as shown below:

Column 6, line 23, change "device" to --devices--.
Column 6, line 24, change "int he" to --in the--.
Column 6, line 39, change "he" to --the--.
Column 6, line 40, change "int he" to --in the--.
Column 7, line 18, change "receive" to --receiver--.
Column 8, line 36, after "rate" insert --and having a control system which varies the fluid output rate--.
Column 9, line 17, change "lien" to --line--.
Column 9, line 26, change "lien" to --line--.
Column 9, line 50, change "lien" to --line--.

Signed and Sealed this

Seventeenth Day of November, 1992

*Attest:*

DOUGLAS B. COMER

*Attesting Officer*

*Acting Commissioner of Patents and Trademarks*